US006070764A

United States Patent [19]

Cline et al.

[11] Patent Number: 6,070,764

[45] Date of Patent: Jun. 6, 2000

[54] APPARATUS FOR DISPENSING LIQUIDS AND SOLIDS

[75] Inventors: David J. Cline, Newport Beach; Timothy S. Clark, Granada; Stephen P. Gordon, Costa Mesa; Michael R. Engle, Long Beach, all of Calif.

[73] Assignee: Fluid Research Corporation, Costa Mesa, Calif.

[21] Appl. No.: 09/220,826

[22] Filed: Dec. 24, 1998

[51] Int. Cl.[7] ..... B67D 5/60

[52] U.S. Cl. ..... 222/135; 222/145.6; 222/146.2; 222/148; 222/413

[58] Field of Search ..... 222/135, 145.5, 222/145.6, 146.2, 148, 413

[56] References Cited

U.S. PATENT DOCUMENTS

| | | | |
|---|---|---|---|
| 4,407,431 | 10/1983 | Cline et al. | 222/135 |
| 5,305,923 | 4/1994 | Kirschner et al. | 222/145.6 |
| 5,605,252 | 2/1997 | Owen et al. | 222/135 |
| 5,615,801 | 4/1997 | Schroeder et al. | 222/145.6 |
| 5,636,763 | 6/1997 | Furness | 222/148 |
| 5,857,589 | 1/1999 | Cline et al. | 222/135 |
| 5,992,686 | 10/1983 | Cline et al. | 222/135 |

*Primary Examiner*—Joseph A. Kaufman
*Attorney, Agent, or Firm*—Lyon & Lyon LLP

[57] ABSTRACT

A dispensing system including a housing with an interior bulkhead and four progressive cavity pumps mounted within the housing on one side of the bulkhead. The pumps are mounted with the bores in vertical orientation. Gear boxes including bevel gears coupling the vertically mounted pumps with horizontally mounted motors located on the other side of the interior bulkhead. A dispensing head is located above the housing with outlet passages extending from the motors to the dispensing head defining a path to the dispensing head which is continuously upward. The dispensing head includes valves driven by a pneumatic cylinder. A solenoid controls flow of pressurized air to the pneumatic cylinder from a position adjacent the dispensing head on the boom supporting both.

44 Claims, 6 Drawing Sheets

APPARATUS FOR DISPENSING LIQUIDS AND SOLIDS

BACKGROUND OF THE INVENTION

The field of the present invention is devices that meter and dispense singular and plural component liquids and solids.

Systems for mixing and dispensing singular and multi-component materials are well known in the art. An almost infinite variety of substances may be dispensed. Many materials are packaged through dispensing in a fluid or a semi-fluid state. Paint is sprayed, molds are pressure charged with materials, and electronic devices are potted. A variety of means for distributing such materials are available. Where plural components are involved, such systems typically include pumping mechanisms for pumping and metering separate materials in a prescribed ratio to a mixing device that thoroughly mixes these materials together. The mixed composition then flows out of a dispensing nozzle directly to the surface or point of application where the composition is desired.

It has become quite advantageous to very carefully and accurately control the amount of material and sometimes the rate of flow of material dispensed. One such dispensing system is disclosed in U.S. patent application Ser. No. 08/752,768, filed Nov. 20, 1996, now U.S. Pat. No. 5,857, 589 the disclosure of which is incorporated herein by reference. The system employs progressive cavity pumps and provides a system upon which the present disclosure is based. Additional details to the foregoing system are found in U.S. patent application Ser. No. 09/032,404, filed Feb. 27, 1998, now U.S. Pat. No. 5,992,686 the disclosure of which is incorporated herein by reference. These details provide features also applicable to the present disclosure. The employment of carefully controlled progressive cavity pumps in the foregoing disclosed systems provides for highly accurate dispensing of flowable materials.

SUMMARY OF THE INVENTION

The present invention is directed to dispensing systems employing one or more progressive cavity pumps and certain practical aspects enhancing accuracy and utility.

In a first separate aspect of the present invention, a dispensing system including at least one progressive cavity pump further includes a dispensing head. The dispensing head is arranged above the outlet of the pump. The bore of the pump and the outlet passage between the pump outlet and the dispensing head both have paths which are continuously upward. Under circumstances where gas bubbles can migrate through the material to be pumped, the accumulation of gas is avoided, thereby increasing dispensing accuracy. Mixing accuracy is also enhanced where a plurality of pumps are employed with a dispense head.

In a second separate aspect of the present invention, a dispensing system includes one or more progressive cavity pumps associated with a housing such that there again is a continuously upwardly extending pump bore or bores. The pump or pumps is/are driven by a motor or motors respectively. A bulkhead within the housing separates the pumps from the motors. Enhanced safety and system longevity are possible with such a system where flammable or corrosive materials are being handled.

In a third separate aspect of the present invention, the second aspect is further contemplated to include the bulkhead being a fireproof box open to outwardly of the housing. The fireproof box may further contemplate a cover, insulation and a heater or a liquid disposal capability through a drain.

In a fourth separate aspect of the present invention, a dispensing system includes one or more progressive cavity pumps feeding a dispensing head. The head includes one or more valves with a pneumatics actuator. The pneumatic actuator receives a controlled source of pressurized air through a solenoid valve. The dispensing head is mounted above the housing containing the progressive cavity pump or pumps and has the solenoid valve adjacent thereto. Increased accuracy is achieved through a reduction in control response time.

In a fifth separate aspect of the present invention, a dispensing system including a progressive cavity pump further includes a system for introducing fluid to the pump through distribution piping to both the inlet of the pump bore and the outlet of the pump bore. Air may also be introduced. A discharge from the inlet may also be contemplated as a convenient exhaust for residual pumped material and fluid. Such a system and the additions thereto are useful for the cleaning of material from the distribution system for system shutdown, decontamination or a change of distributed materials.

In a sixth separate aspect of the present invention, combinations of the foregoing aspects are contemplated.

Accordingly, it is an object of the present invention to provide a dispensing system with improved dispensing accuracy. Other and further objects and advantages will appear hereafter.

DETAILED DESCRIPTION OF THE PREFERRED EMBODIMENTS

Figure 1:
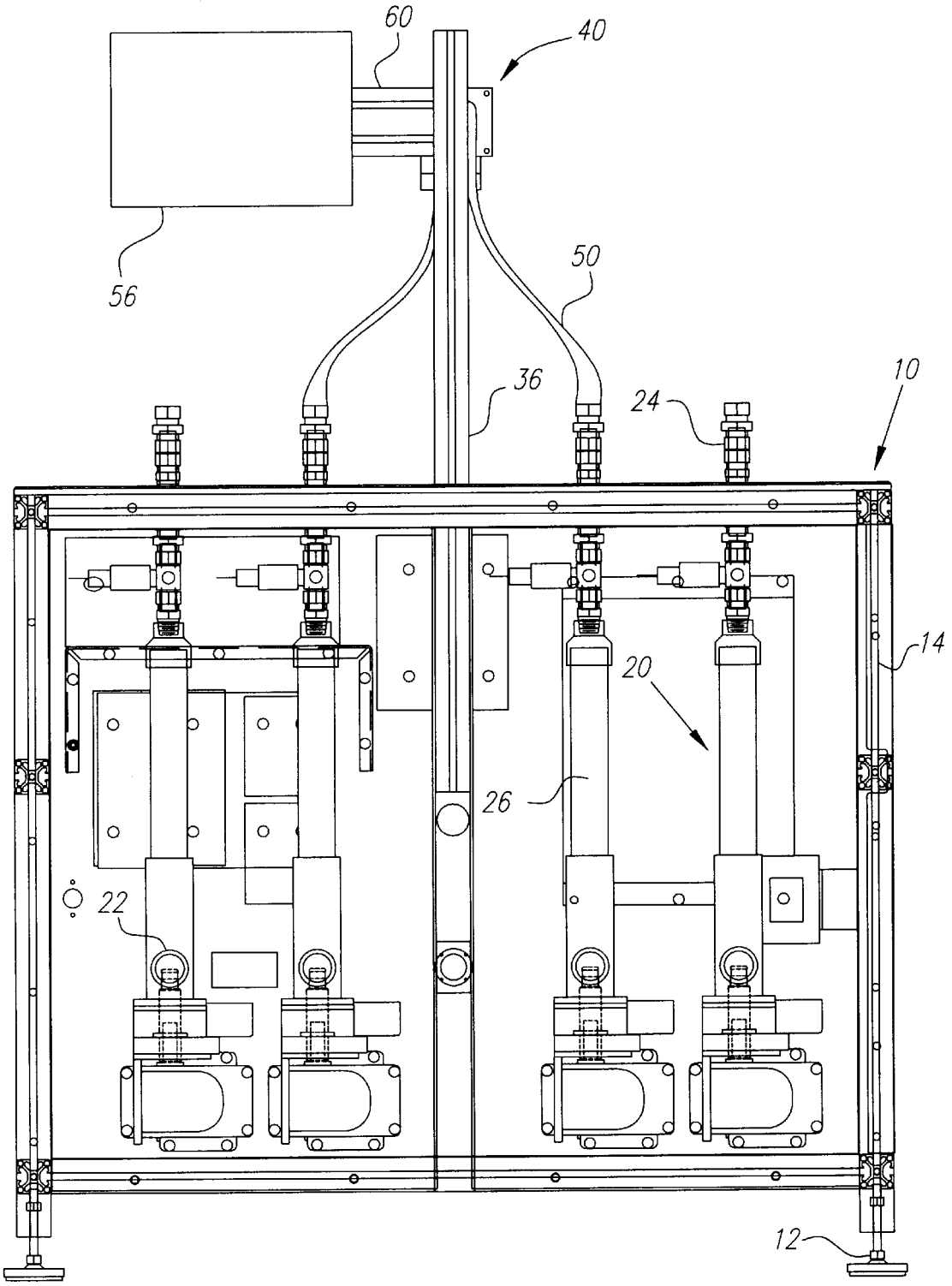
FIG. 1 is a back view of a dispensing system with the rear cover removed for clarity.
Figure 2:
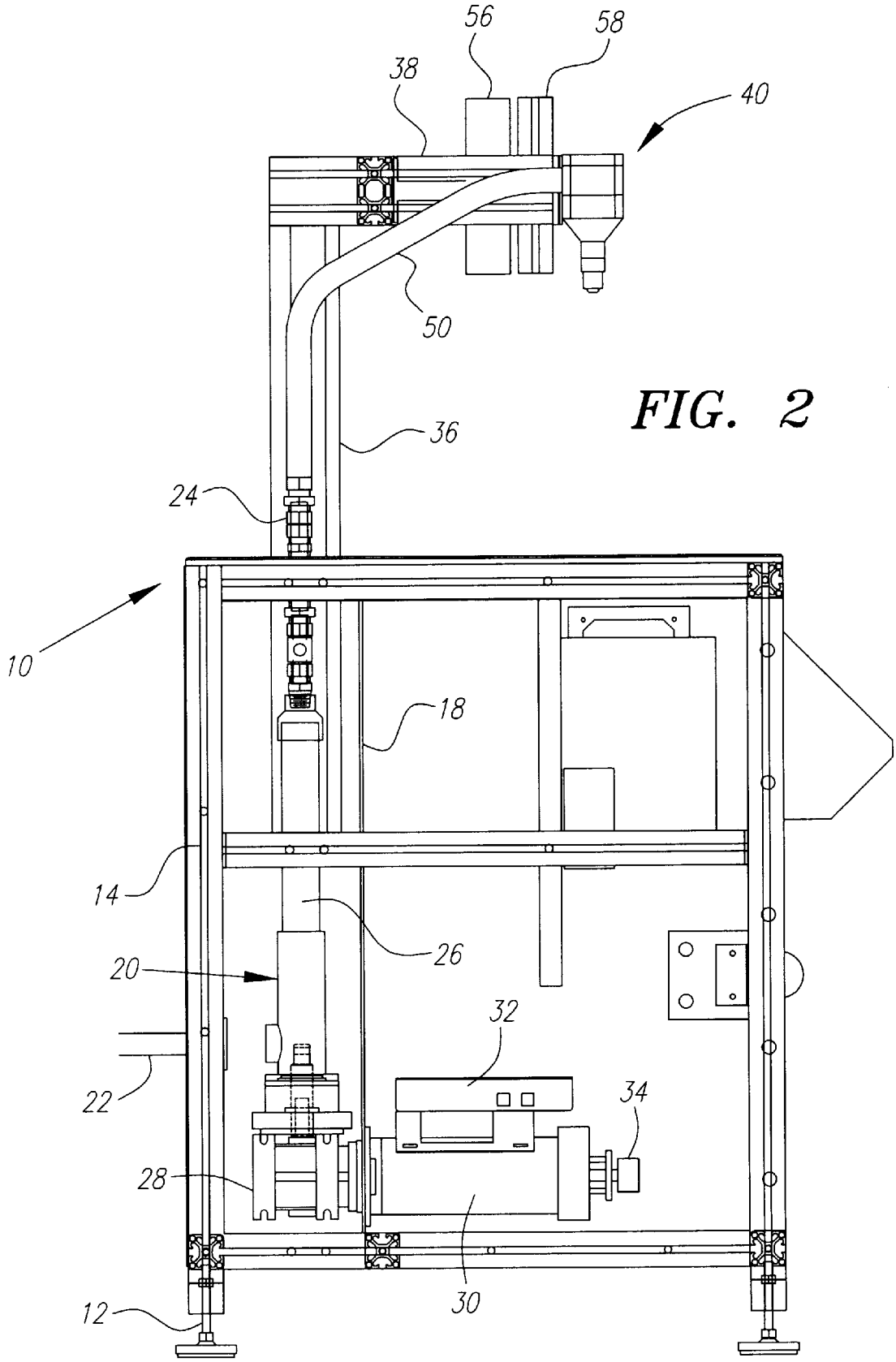
FIG. 2 is a side view of the dispensing system of FIG. 1 with the side cover removed for clarity.
Figure 3:
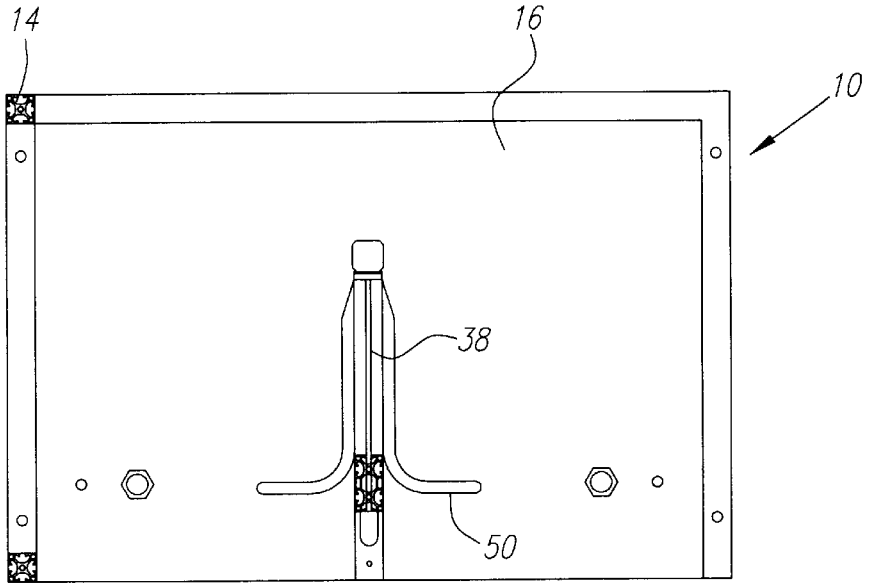
FIG. 3 is a top view of the dispensing system of FIG. 1.
Figure 4:
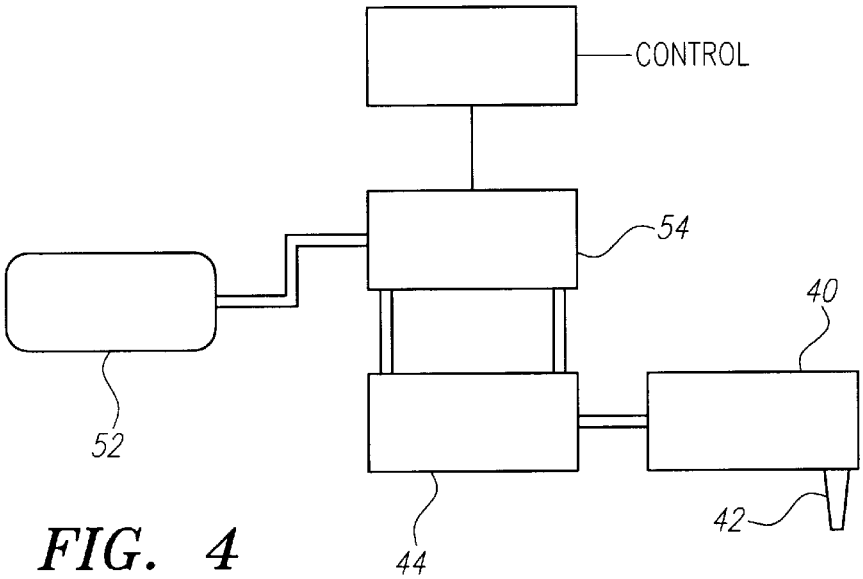
FIG. 4 is a schematic of the valve control system of the dispensing system.
Figure 5:
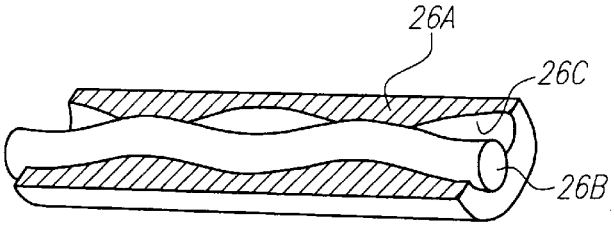
FIG. 5 is a cross-sectional prospective representation of a progressive cavity pump.

Turning in detail to the drawings, the structural layout of the dispensing system is illustrated in FIGS. 1 through 3. A housing, generally designated 10, is illustrated as defining a metal box with four feet 12. A metal frame 14 supports sheet metal panels, removed for clarity of disclosure. A top panel 16 provides a working surface for positioning work for receipt of dispensed fluids; and an interior bulkhead 18 extends through the housing 10. The bulkhead 18 is shown to be in a vertical plane. However, the bulkhead 18 may take on any appropriate shape and orientation. Preferably, the bulkhead 18 defines two or more volumes within the housing. Appropriate access doors and ports are also contemplated in the housing for convenience.

A plurality of progressive cavity pumps 20 are mounted within the housing 10. Four such pumps are illustrated in the embodiment of FIGS. 1 through 3. These pumps 20 include an inlet 22, an outlet 24, and a pump body 26. The pump body 26 is defined by a cylindrical tube with a stator assembly located therein. The stator assembly has a bore defining a helix with double helix threads. The bore extends from the inlet 22 to the outlet 24. Multiple progressive cavities are defined as the rotor is rotated within the stator. The pump body 26 is oriented vertically with the inlet 22 adjacent to the bottom and the outlet 24 at the top. The inlet 22 of each of the pumps 20 extends from outwardly of the housing 10 through a wall thereof to the pump. The outlet extends upwardly through the top panel 16 of the housing 10.

The orientation and positioning of the progressive cavity pumps 20 are such that they are located to one side of the interior bulkhead 18. Through their vertical arrangement, the bore of each of the pumps 20 has a path from the inlet to the outlet which is continuously upward. Thus, there are no cavities which can accumulate or retain gas bubbles within the material being pumped.

Each pump rotor extends to a rotational access at one end of the respective pump 20. A gear box 28 is coupled with the rotational access at the end of each pump 20. A seal gland is provided about the rotational access to avoid the flow of pumped material toward the gear box 28. The gear boxes 28 each include a bevel gear with rotatably mounted shafts at 90°. The first shaft couples with one of the pumps 20 while the second extends through the interior bulkhead 18. Motors 30 located on the other side of the interior bulkhead 18 from the pumps 20 couple with the second shafts of the gear boxes 28. The motors are also shown to include motor controllers 32 and encoders 34.

The power supply, electronics and certain controls are mounted to the housing in a cavity not including the pumps 20. This location may be with the motors on one side of the interior bulkhead 18.

A boom 36 extends upwardly from the housing 10 adjacent to the back panel thereof with a lateral arm 38 extending toward the front of the housing 10 above the top panel 16.

Figure 6:
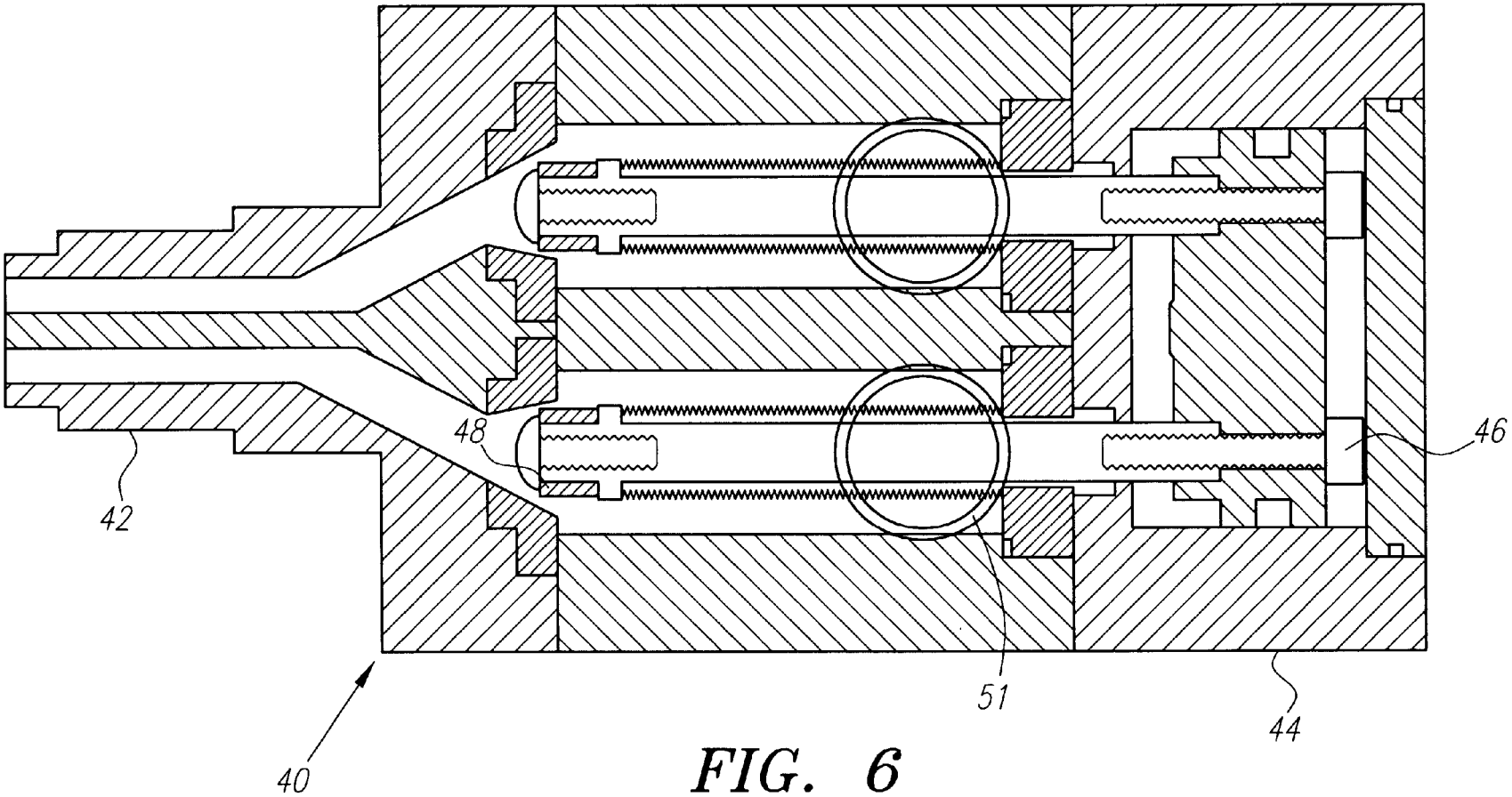
FIG. 6 is a cross-sectional diagram of a dispense head.

A dispensing head 40 is located at the end of the arm 38. The dispensing head 40 includes a downwardly extending nozzle 42 which may receive a static mixer (not shown) in the case of plural components. A flex hose (not shown) leading to a remote application may also be employed. The dispensing head 40 includes a pneumatic cylinder with an enclosed piston 46. The piston 46 is shown to be coupled to two valves 48. Outlet passages 50, typically provided by a flexible hose, couple the outlet 24 with the dispensing head 40. The valves 48 control flow from the progressive cavity pumps 20 through the outlet passages 50 to the nozzle 42. The dispense head shown in FIG. 6 has two inlet ports 51. Two outlet passages 50 are shown to couple two pumps 20 to these ports 51. Multiple dispense heads 40 or a four passage dispense head may be used if all four pumps are to be accessed. When multiple heads 40 are used, one or even both of the heads may be remote from the housing. It is also contemplated that less than all pumps 20 may be employed at any one time.

The outlet passages 50 between the outlets 24 and the dispensing head 40 also have a path of travel which is continuous upward to avoid accumulation or retention of gas within the pumped material.

Control of the valves 48 through the pneumatic cylinder is through the control of a source 52 of pressurized gas. A solenoid valve or valves 54 control supply of the pressurized gas. The solenoid valve is located in a valve housing 56 mounted to the boom 36 adjacent to the dispensing head 40. The location of the solenoid valve 54 proximate to the pneumatic cylinder driving the valves 48 substantially shortens the path of the pressure wave acting to operate the pneumatic cylinder for valve opening or closing. Thus, greater accuracy is achieved. A control panel 58 is also mounted on the bracket 60 with the valve housing 56.

Figure 7:
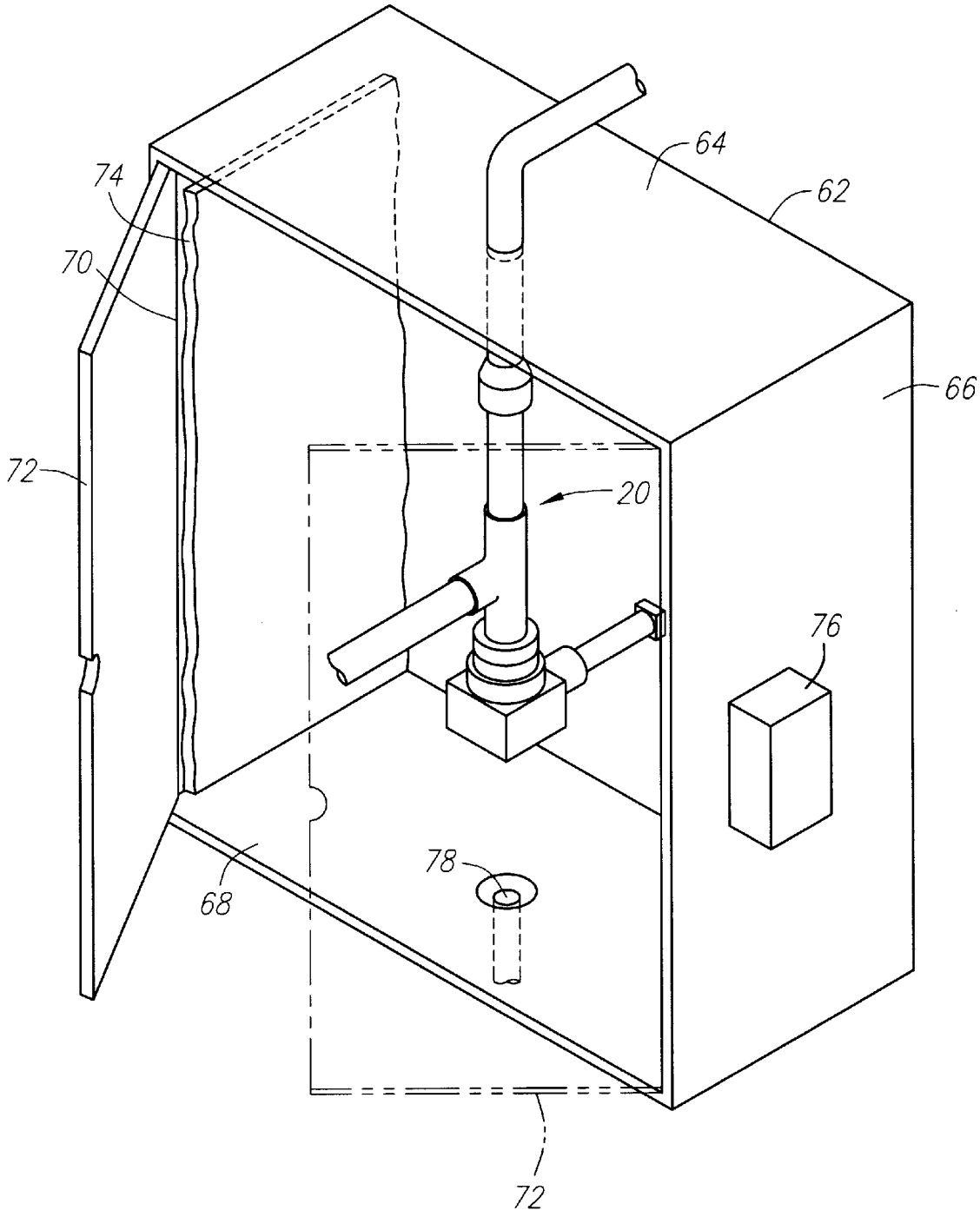
FIG. 7 is a simplified perspective view of the housing with a fireproof box including a pump.

The dispensing of engineering and production components includes the possibility that these components will be flammable or explosive. The bulkhead 18 contemplates the division of the housing into two or more volumes. The bulkhead is able to separate the electronics and electrical systems from the liquid and other flowable material processed. The materials can be pressurized and, upon leakage, could distribute harmful liquid or vapor into the housing. The bulkhead 18 of FIG. 2 provides substantial division between the pump components and the electrical and electronic equipment. The bulkhead may be further configured as illustrated in FIG. 7 to define a box 62 which may surround one or more of the progressive cavity pumps 20. Where it is possible that the dispensed materials from two of the pumps would be dangerously reactive, multiple such boxes 62 are contemplated.

The boxes 62 are preferably of metal and are, therefore, fireproof. The box in FIG. 7 is illustrated as including a top 64, sides 66 and a bottom 68. One of the sides of the box 62 is an opening 70 which faces outwardly from the housing 10. A cover 72 may be associated with the box 62 to provide a complete enclosure. Such a cover 72 may be mounted to the box 62 or may be mounted on the housing 10. The mounting may be with hinges or simple fasteners.

The presence of the box 62 may lend itself to other features of functional advantage. For example, insulation 74 may line the box 62 and also the cover 72. Additionally, a heater 76 may be in thermal communication with the box 62 to elevate the temperature of the pumps 20 and in turn the material passing therethrough. The heater 76 may be specifically present within the box 62 or may convey heat through conduction or forced air into the box 62 from outwardly thereof. Seals can be employed about the inlet 22, the outlet 24 and the shaft of the motor 30 to further isolate the pump compartment. The cover 72 may be in multiple pieces to avoid interference with the inlet 22.

Even with the full closure of the compartment containing the pump or pumps 20, a drain 78 may be provided in the bottom of the box 62 to drain outwardly of the housing 10. A separate sump (not shown) may be provided in the facility for receiving and appropriately handling any escaping liquids.

Figure 8:
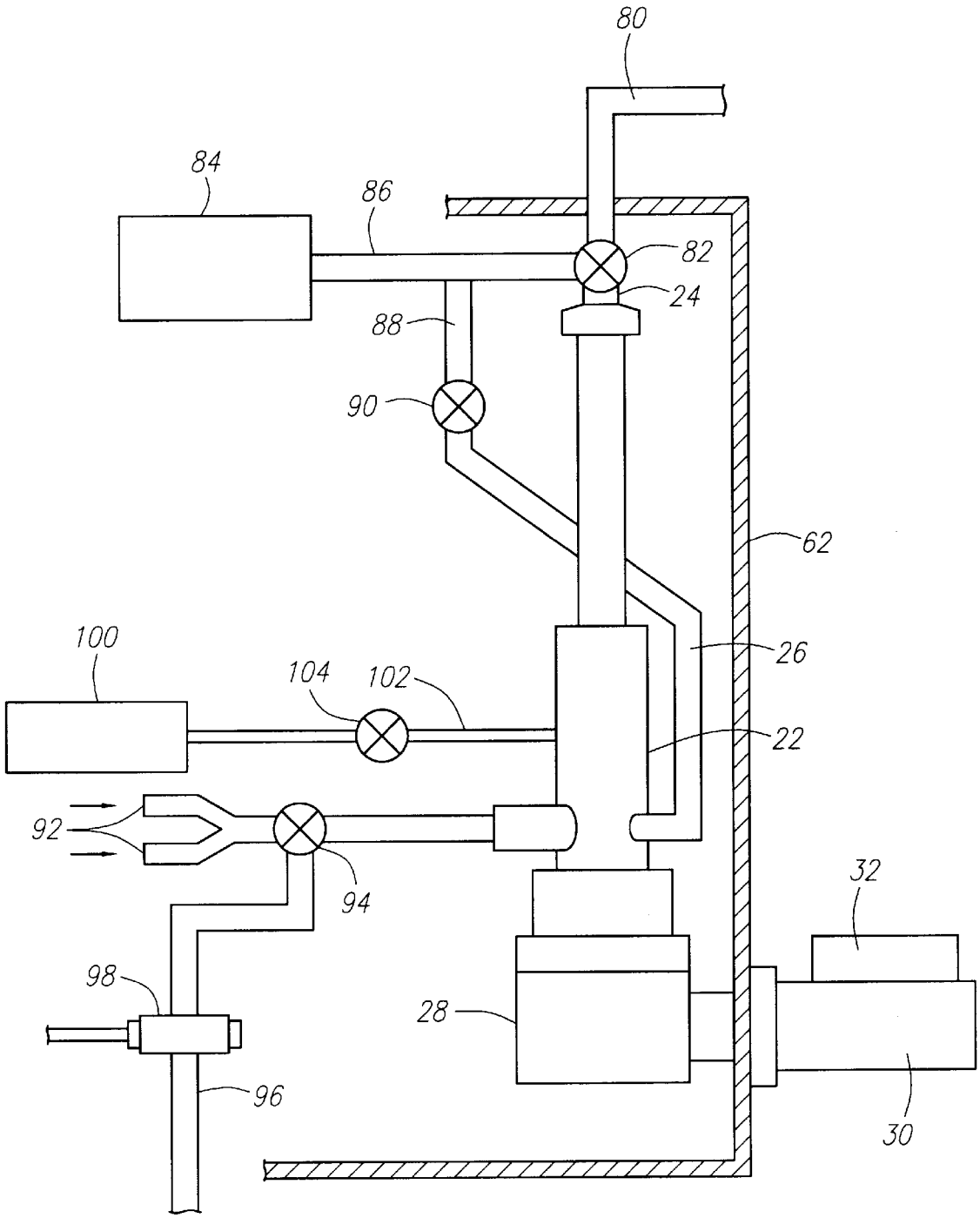
FIG. 8 is a piping schematic of a cleaning system with a progressive cavity pump of the dispensing system.

The materials pumped through the one or more pumps 20 are contemplated to be quite varied in nature and handling requirements. The uses to which the entire dispensing system are put may also be of substantial variation. Consequently, it is advantageous to provide a mechanism for the easy purging and cleaning of the dispensing system. This may be of value as a simple procedure to change materials employed, to decontaminate the fluid passages or to clear materials exhibiting handling problems such as corrosion, set up and the like. This would be particularly true for food products. FIG. 8 illustrates a system employing a pressurized fluids. One fluid contemplated would be a solvent for the material found within the flow passages. Compressed air may also be used.

The pump 20 is shown mounted to a bulkhead 18 in FIG. 8 in a manner previously disclosed. The pump body 26 is generally upwardly directed with an inlet 22 below the pump body 26 and an outlet 24 above the pump body 26. The pump body 26 continues to be defined by a cylindrical tube with a stator assembly located therein. The stator assembly includes a bore to receive a helical rotor. The pump is driven from below by a motor 30 driving through a gearbox 28.

The outlet 24 includes an outlet passage 80. This outlet passage 80 extends to a dispense head or other outlet. The outlet passage 80 may be a separate conduit, a passage through a dispense head or other distribution system or some combination of the two. A valve 82 is positioned at the outlet 24 to control the passage of material to and from the outlet 24 and to and from the outlet passage 80. Albeit convenient where located in FIG. 8, this valve 82 may be located somewhat further away from the pump than illustrated.

A source of fluid 84 is placed into communication with the valve 82 on the outlet 24 through distribution piping 86. The distribution piping 86 connects to the valve 82. The valve 82 may be a three-way or four-way valve. Preferably the valve can be positioned in any of two or three positions, the first being with communication from the outlet 24 to the outlet passage 80 and the second being communication between the distribution piping 86 and the outlet 24. A third would simply result in a closure of all possible communication through the junction defined by the valve 82. The source of fluid 84 may be under pressure to insure positive flow into the pump.

The distribution piping 86 further includes a section 88 extending into communication with the inlet 22 of the pump 20. A valve 90 is positioned in the section of piping 88 to control communication with the inlet 22. The valve 90 would be a two-way valve allowing flow through the distribution piping 86 in one position and preventing all flow therethrough in the other.

The inlet 22 includes at least one inlet passage 92. Two inlet passages 92 are illustrated. These passages 92 converge on a valve 94 in communication with the inlet 22. A discharge passage 96 extends from the inlet valve 94 as well. Thus, the inlet valve 94 is in communication with the inlet 22, the discharge passage 96 and one or more inlet passages 92, two being shown. This inlet valve 94 may also have three or four positions as illustrated in this embodiment. In a first position, the inlet valve 94 would allow communication between one of the inlet passages 92 and the inlet 22. In a second position, the other inlet passage 92 would communicate with the inlet 22. In a third position, the discharge passage 96 would be in communication with the inlet 22. A fourth position would have all communication blocked. The discharge passage 96 may include an optical sensor 98 to determine when the discharge is running clean.

A source of pressurized air 100 is coupled with the inlet 22 by way of an air passage 102. An air valve 104 controls flow of the pressurized air.

In operation, a number of states may be employed with the purging and cleaning system. The several valves involved may be regulated either manually or through the dispensing system computer. The valve 82 associated with the outlet 24 may first be shifted from a dispensing state where communication extends between the outlet 24 and the dispensing head 40 to a solvent inlet state with communication being between the source of fluid 84 and the outlet 24. Next, the inlet valve 94 is shifted from a material inlet state to a state of discharge with communication between the inlet 22 and the discharge passage 96. The valve 90 may also be opened at this time depending upon the desired flow quantity and flow pattern. Pressurized air from the source of pressurized air 100 may be introduced through the air valve 104.

With the pump not running, the foregoing state causes solvent from the source of fluid 84 to flow through the valve 90 and force material from the inlet 22 through the discharge passage 96. The pressurized air adds scrubbing action which will further purge material from the inlet 22 at the pump suction casing. With the valve 90 open, flow of solvent will also directly cleanse the inlet 22 and flow to discharge. With the valve 90 closed, flow will only be from the outlet 24 to the inlet 22.

With the valves in the state as described, the pump may be run backwards. This will result in solvent being admitted to the outlet 24 to run backwards through the pump 20 and to the discharge passage 96. The optical sensor 98 can be used to determine the amount of material remaining in the solvent. Alternating forward and backward cycles of the pump with the valves 82 and 90 open to the distribution piping 86 will insure a cleaning and complete purging of the material from the pump 20. With such alternating flow, the inlet valve 94 may be temporarily closed or constricted to conserve solvent.

Once the pump has been purged, the inlet valve 94 can be closed to the discharge passage 96 so that there is no communication of either the inlet passages 92 or the discharge passage 96 with the inlet 22. The outlet valve 82 is changed to a dispensing state with communication between the outlet 24 and the dispensing head 40. The air valve 104 may also be closed leaving the valve 90 communicating between the source of fluid 84 and the inlet 22. The pump 20 can then be run in the forward direction to purge the dispensing system downstream of the pump 20. When a clean flow of solvent is sensed from the dispense head 40, the system is completely purged. Finally, the valve 90 can be closed, the inlet valve opened to the discharge passage 96 and the air valve 104 opened as well. All remaining solvent can then be purged from the system through the dispense head 40 and the discharge passage 96 with the pump driven forward. Finally, the air valve 104 may be closed and the pump is ready to receive new material to be introduced through an inlet passage 92. Other fluids such as steam and inert gas may be employed in place of the solvent and air.

Accordingly, an improved dispensing system including features for accurate dispensing of material is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A dispensing system comprising a housing including an interior bulkhead;

at least one progressive cavity pump mounted in the housing and being on a first side of the bulkhead, each of the at least one progressive cavity pump including a rotor formed as a helix and a stator with a bore therethrough, the rotor extending through the bore of the stator with a progressive cavity between the rotor and the stator with rotation of the rotor, the bore having an inlet and an outlet, the bore having a path from the inlet to the outlet which is continuously upward;

at least one motor mounted in the housing and being on a second side of the bulkhead and coupled with the rotor of the at least one progressive cavity pump, respectively.

2. The dispensing system of claim 1 further comprising at least one gearbox coupled between the at least one motor and the at least one progressive cavity pump, respectively.

3. The dispensing system of claim 2, the at least one gear box being to the first side of the bulkhead.

4. The dispensing system of claim 1, each progressive cavity pump stator being oriented with the bore extending vertically.

5. The dispensing system of claim 1, the inlet including a line extending from outwardly of the housing and being to the first side of the bulkhead.

6. The dispensing system of claim 1 further comprising a dispensing head above the housing;

at least one outlet passage between each outlet, respectively, and the dispensing head, each outlet passage having a path to the dispensing head which is continuously upward.

7. The dispensing system of claim 6, the dispensing head including a nozzle, the pump outlet of each of the at least one progressive cavity pump being in controlled fluid communication with the nozzle.

8. The dispensing system of claim 7, the dispensing head further including at least one valve controlling fluid communication between the at least one progressive cavity pump, respectively, and the nozzle and a pneumatic actuator coupled with the at least one valve.

9. The dispensing system of claim 8 further comprising a boom extending upward from the housing, the dispensing head being mounted to the boom;

a source of pneumatic pressure;

at least one solenoid valve mounted to the boom adjacent the dispensing head controlling communication between the source of pneumatic pressure and the at least one pneumatic actuator, respectively.

10. The dispensing system of claim 1, the bulkhead forming a fireproof box including an opening facing outwardly of the housing.

11. The dispensing system of claim 10, the fireproof box including a cover closing the opening.

12. The dispensing system of claim 11, the fireproof box further including insulation and a heater in thermal communication with the interior of the fireproof box to heat the interior thereof.

13. The dispensing system of claim 10, the fireproof box including a drain from the interior of the fireproof box to outwardly of the housing.

14. A dispensing system comprising a housing including an interior bulkhead;

a plurality of progressive cavity pumps mounted in the housing and being on a first side of the bulkhead, each of the progressive cavity pumps including a rotor formed as a helix and a stator with a bore therethrough, the rotor extending through the bore of the stator with a progressive cavity between the rotor and the stator with rotation of the rotor, the bore having an inlet and an outlet, all parts of the bore having a path to the outlet which is continuously upward;

a plurality of motors mounted in the housing and being on a second side of the bulkhead and coupled with the rotors of the progressive cavity pumps, respectively.

15. The dispensing system of claim 14, the bulkhead forming a fireproof box including an opening facing outwardly of the housing.

16. The dispensing system of claim 15, the fireproof box including a cover closing the opening.

17. The dispensing system of claim 16, the fireproof box further including insulation and a heater in thermal communication with the interior of the fireproof box to heat the interior thereof.

18. The dispensing system of claim 15, the fireproof box including a drain from the interior of the fireproof box to outwardly of the housing.

19. The dispensing system of claim 14 further comprising a plurality of gearboxes coupled between the plurality of motors and the plurality of progressive cavity pumps, respectively.

20. The dispensing system of claim 19, the plurality of gear boxes being to the first side of the bulkhead.

21. The dispensing system of claim 14, each progressive cavity pump stator being oriented with the bore extending vertically, with the outlet at the top of the bore and with the inlet at the bottom of the bore.

22. The dispensing system of claim 14, each inlet including a line extending from outwardly of the housing and being to the first side of the bulkhead.

23. The dispensing system of claim 14 further comprising a dispensing head above the housing;

outlet passages between the outlets, respectively, and the dispensing head, each outlet passage having a path to the dispensing head which is continuously upward.

24. The dispensing system of claim 23, the dispensing head including a nozzle, the pump outlets of the plurality of progressive cavity pumps being in controlled fluid communication with the nozzle.

25. The dispensing system of claim 24, the dispensing head further including valves controlling fluid communication between the progressive cavity pumps, respectively, and the nozzle and a pneumatic actuator coupled with the valves.

26. The dispensing system of claim 25 further comprising a boom extending upward from the housing, the dispensing head being mounted to the boom;

a source of pneumatic pressure;

a plurality of solenoid valves mounted to the boom adjacent the dispensing head controlling communication between the source of pneumatic pressure and the at least one pneumatic actuator, respectively.

27. A dispensing system comprising at least one progressive cavity pump, each of the at least one progressive cavity pump including a rotor formed as a helix and a stator with a bore therethrough, the rotor extending through the bore of the stator with a progressive cavity between the rotor and the stator with rotation of the rotor, the bore having an inlet and an outlet, the bore having a path from the inlet to the outlet which is continuously upward;

a dispensing head above the at least one progressive cavity pump;

at least one outlet passage between each outlet, respectively, and the dispensing head, each outlet passage having a path to the dispensing head which is continuously upward.

28. The dispensing system of claim 27, the dispensing head including a nozzle, the pump outlet of each of the at least one progressive cavity pump being in controlled fluid communication with the nozzle.

29. The dispensing system of claim 28, the dispensing head further including at least one valve controlling fluid communication between the at least one progressive cavity pump, respectively, and the nozzle and a pneumatic actuator coupled with the at least one valve.

30. The dispensing system of claim 29 further comprising a boom extending upward from the housing, the dispensing head being mounted to the boom;

a source of pneumatic pressure;

at least one solenoid valve mounted to the boom adjacent the dispensing head controlling communication between the source of pneumatic pressure and the at least one pneumatic actuator, respectively.

31. A dispensing system comprising a plurality of progressive cavity pumps, each of the progressive cavity pumps including a rotor formed as a helix and a stator with a bore therethrough, the rotor extending through the bore of the stator with a progressive cavity between the rotor and the stator with rotation of the rotor, the bore having an inlet and an outlet, all parts of the bore having a path to the outlet which is continuously upward;

a dispensing head above the plurality of progressive cavity pumps;

a plurality of outlet passage between the outlets, respectively, and the dispensing head, each outlet passage having a path to the dispensing head which is continuously upward.

32. A dispensing system comprising a housing;

a plurality of progressive cavity pumps mounted in the housing, each of the progressive cavity pumps including a rotor formed as a helix and a stator with a bore therethrough, the rotor extending through the bore of the stator with a progressive cavity between the rotor and the stator with rotation of the rotor, the bore having an inlet and an outlet, all parts of the bore having a path to the outlet which is continuously upward;

a plurality of motors mounted in the housing and being coupled with the rotors of the progressive cavity pumps, respectively;

a dispensing head above the housing, the dispensing head including a nozzle, the pump outlets of the plurality of progressive cavity pumps being in controlled fluid communication with the nozzle, valves controlling fluid communication between the progressive cavity pumps, respectively, and the nozzle and a pneumatic actuator coupled with the valves;

outlet passages between the outlets, respectively, and the dispensing head, each outlet passage having a path to the dispensing head which is continuously upward;

a boom extending upward from the housing, the dispensing head being mounted to the boom;

a source of pneumatic pressure;

a plurality of solenoid valves mounted to the boom adjacent the dispensing head controlling communication between the source of pneumatic pressure and the at least one pneumatic actuator, respectively.

33. A dispensing system comprising a progressive cavity pump including a rotor formed as a helix and a stator with a bore therethrough, the rotor extending through the bore of the stator with a progressive cavity between the rotor and the stator with rotation of the rotor, the bore having an inlet and an outlet;

a source of fluid;

distribution piping between the source of fluid and the inlet to the bore and between the source of fluid and the outlet from the bore;

a first valve in the distribution piping between and controlling communication between the source of fluid and the inlet;

a second valve in the distribution piping between and controlling communication between the source of fluid and the outlet.

34. The dispensing system of claim 33, the distribution piping extending in communication between the inlet to the bore and the outlet from the bore through the first valve and the second valve.

35. The dispensing system of claim 33 further comprising a dispense head in communication with the outlet from the bore through the first valve, the second valve having a first position with communication solely between the dispense head and the outlet from the bore and a second position with communication solely between the source of fluid and the outlet from the bore.

36. The dispensing system of claim 33 further comprising a source of pressurized air in communication with the inlet to the bore;

an air valve controlling communication between the source of pressurized air and the inlet to the bore.

37. The dispensing system of claim 33 further comprising at least one inlet passage in communication with the inlet to the bore;

a discharge passage to waste in communication with the inlet passage;

an inlet valve in the at least one inlet passage and in the discharge passage controlling communication between the at least one inlet passage and the inlet to the bore and between the discharge passage and the inlet to the bore.

38. The dispensing system of claim 33, there being at least two inlet passages.

39. The dispensing system of claim 33, the source of fluid having the fluid under pressure.

40. The dispensing system of claim 33, the bore having a path from the inlet to the outlet which is continuously upward.

41. A dispensing system comprising a progressive cavity pump including a rotor formed as a helix and a stator with a bore therethrough, the rotor extending through the bore of the stator with a progressive cavity between the rotor and the stator with rotation of the rotor, the bore having an inlet and an outlet;

a source of fluid;

distribution piping in communication with the source of fluid, the inlet to the bore and the outlet from the bore;

a first valve in the distribution piping between and controlling communication between the source of fluid and the inlet;

a second valve in the distribution piping between and controlling communication between the source of fluid and the outlet;

a dispense head in communication with the outlet from the bore through the first valve, the second valve having a first position with communication solely between the dispense head and the outlet from the bore and a second position with communication solely between the source of fluid and the outlet from the bore;

at least one inlet passage in communication with the inlet to the bore;

a discharge passage to waste in communication with the inlet passage;

an inlet valve in the at least one inlet passage and in the discharge passage controlling communication between the at least one inlet passage and the inlet to the bore and between the discharge passage and the inlet to the bore.

42. The dispensing system of claim 41 further comprising a source of pressurized air in communication with the inlet to the bore;

an air valve controlling communication between the source of pressurized air and the inlet to the bore.

43. The dispensing system of claim 41, the source of fluid having the fluid under pressure.

44. The dispensing system of claim 41, the bore having a path from the inlet to the outlet which is continuously upward.

* * * * *